United States Patent [19]

Drdlik

[11] 4,382,529

[45] May 10, 1983

[54] SANITARY DISPENSING CLOSURE

[76] Inventor: Frank J. Drdlik, 3634 San Jose La., Santa Barbara, Calif. 93105

[21] Appl. No.: 216,569

[22] Filed: Dec. 15, 1980

[51] Int. Cl.[3] ..... B65D 47/00

[52] U.S. Cl. ..... 222/531; 222/545; 222/556; 251/310; 222/548

[58] Field of Search ..... 222/531, 540, 548, 556, 222/545, 338, 517; 251/310

[56] References Cited

U.S. PATENT DOCUMENTS

| | | | |
|---|---|---|---|
| 378,366 | 2/1888 | Hoyt | 222/548 |
| 2,938,653 | 5/1960 | Church et al. | 222/536 |
| 3,718,238 | 2/1973 | Hazard et al. | 222/556 |

*Primary Examiner*—H. Grant Skaggs

[57] ABSTRACT

A closure device is disclosed herein for use in conjunction with a plastic squeeze discharge container which includes a screw-on type of bottle cap provided with a pair of indentures or cavities arranged normal to each other and a two-pronged, elbow shaped combined actuator and dispensing nozzle which movably fits into the indentures or cavities. A selected cavity is provided with a reduced entrance so as to insertably receive and snap-lock with the dispensing nozzle. The other cavity is formed to correspond to the shape of the actuator so as to recess the actuator into the cap. A finger engaging portion of the actuator extends beyond the exterior of the cap. An orifice is formed in the cap supporting the dispensing nozzle which registers with a hole in the side of the nozzle communicating with an elongated passageway that terminates in a discharge opening. The opening is indexed with the orifice when the actuator is in a raised or actuated position while a sidewall of the nozzle blocks the orifice when the actuator is in its recessed or non-actuator position.

7 Claims, 5 Drawing Figures

FIG. 1
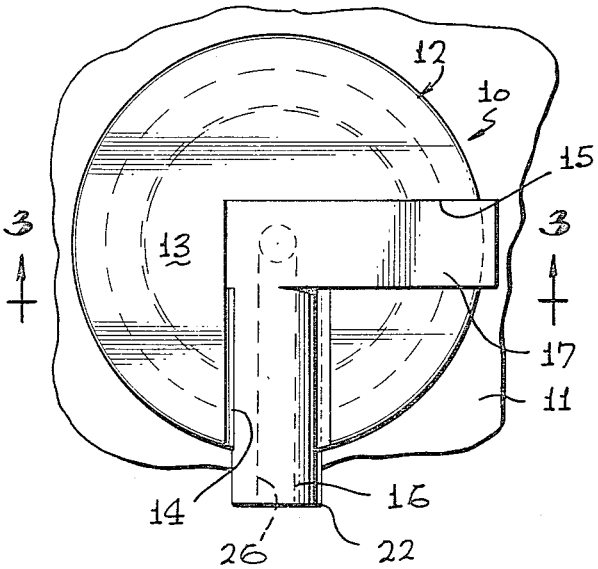
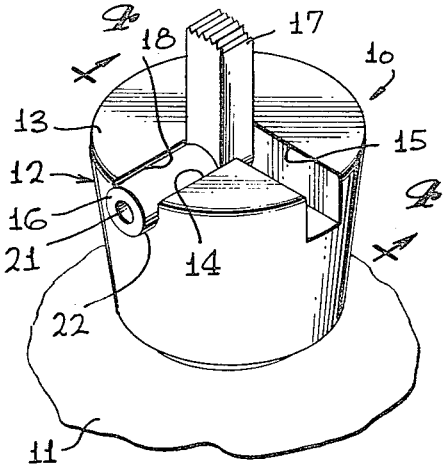
FIG. 2
FIG. 3
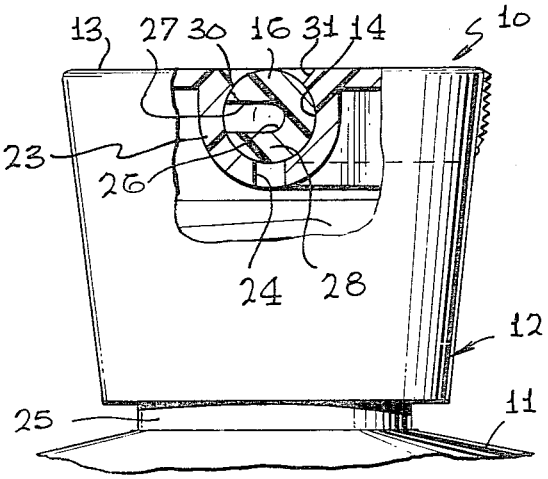
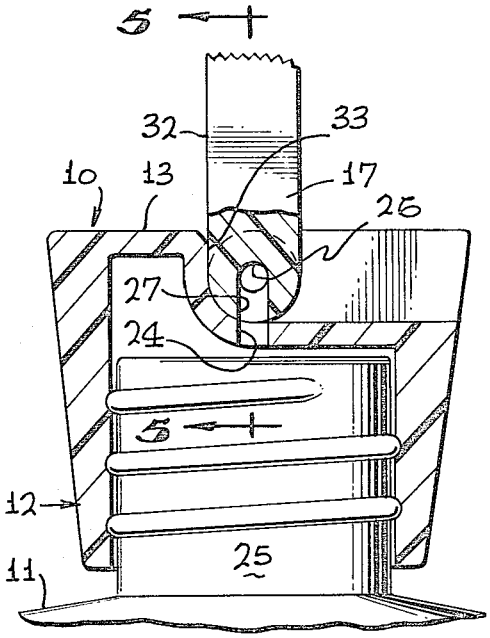
FIG. 5
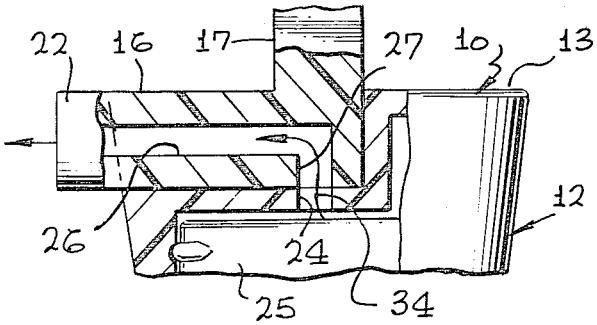
FIG. 4

SANITARY DISPENSING CLOSURE

BACKGROUND OF THE INVENTION

1. Field of the Invention

The present invention relates to improved spouts for a dispensing closure and more particularly, to a novel dispensing closure of an elbow type which is sanitary and convenient to use.

2. Brief Description of the Prior Art

The term "dispensing closures" is commonly employed at the present time to designate closures for containers, which closures are capable of being manipulated so that the contents of a container sealed by one of these closures may be dispensed without removing the particular closure involved from the container. Dispensing closures of the type to which the present invention relates generally comprise a pivotal cylindrical knuckle with a nozzle extending therefrom and a base such as a bottle cap with which it is associated for swiveling movement.

However, difficulties and problems have been encountered with such conventional dispensing closures which stem largely from the fact that the nozzle and actuator for positioning the nozzle are the same and identical piece which is unsanitary in that the user's fingers must come into contact with the dispensing orifice in the nozzle through which the food product flows, Modern day sanitary requirements mandate that, in no case, shall a dispensing closure used in the course of discharge of food products for human consumption be allowed when the public's thumbs or fingers, employed in the operation of such closures, would come in contact with the food stuffs or products.

Therefore, a long standing need has existed to provide a novel dispersing closure which is sanitary and which employs an actuator removed from the dispensing orifice of the nozzle.

SUMMARY OF THE INVENTION

Accordingly, the above problems and difficulties are obviated by the present invention which provides a bottle cap having a pair of cavities formed therein at right angles with respect to each other and which further includes a two pronged, elbow shaped combined actuator and dispensing nozzle which movably fits into the cavities. The actuator portion and the dispensing nozzle portion of the combination are arranged at ninety degree angles with respect to one another so as to correspond with the configuration of the cavities. A selected cavity is provided with a reduced entrance so as to insertably receive and snap lock with the dispensing nozzle portion while the other cavity is formed to correspond to the shape of the actuator so as to recess the actuator into the cap. A portion of the actuator extends beyond the external surface of the cap for finger engaging purposes. The dispensing nozzle is provided with an elongated passageway having a discharge orifice at one end for issuing the food stuffs or products therefrom and having a hole at its opposite end formed through the sidewall of the nozzle which is selectively indexed or registered with an aperture in the top of the cap itself. When the actuator is in a raised position, the dispensing nozzle portion is rotated to register the hole with the aperture so that the food product within the container may be introduced into the passageway and discharged from the end of the nozzle. When the actuator is in its recessed position, the nozzle portion is rotated so that the hole and aperture are out of registry and separated by the sidewall of the nozzle portion.

Therefore, the user's fingers never come into contact with the nozzle portion since only finger contact is made with the actuator which is in fixed space relationship with respect to the nozzle portion.

Therefore, it is among the primary objects of the present invention to provide a novel dispensing closure wherein the user's fingers do not come in contact with the dispensing nozzle of the closure.

Another object of the present invention is to provide a sanitary dispensing closure which may be readily opened and closed by the user's fingers without coming in contact with the dispensing nozzle or orifice thereof.

Still a further object of the present invention is to provide a novel sanitary dispensing closure involving moving parts which effectively seal against leakage.

Still a further object of the present invention is to provide a novel two piece sanitary dispensing closure means which is relatively simple to manufacture and which may be readily assembled and installed without expensive machinery or excessive manpower.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings, in which:

FIG. 1 is a top plan view showing the novel sanitary dispensing closure means in its non-dispensing condition;

FIG. 2 is a perspective view illustrating the dispensing closure means in its dispensing condition;

FIG. 3 is an enlarged cross sectional view of the dispensing closure means shown in FIG. 1 as taken in the direction of arrows 3—3 thereof;

FIG. 4 is a cross sectional view of the dispensing closure means shown in FIG. 2 as taken in the direction of arrows 4—4 thereof; and FIG. 5 is a fragmentary cross sectional view taken in the direction of arrows 5—5 of FIG. 4.

DESCRIPTION OF PREFERRED EMBODIMENT

As shown in FIG. 1, the novel sanitary dispensing closure means of the present invention is illustrated in the general direction of arrow 10 and is employed in conjunction with a plastic squeeze-type container 11 which normally holds a quantity of liquid or semi-liquid food product. The novel dispensing closure means includes a cap 12 which is of an ordinary screw type bottle cap having a top surface 13 having a pair of indentures or cavities arranged at ninety degrees with respect to one another and as generally identified by numerals 14 and 15. The cavities form a receptacle for receiving a two pronged, elbow shaped combined dispensing nozzle and actuator identified respectively by numerals 16 and 17. The screw on cap 12 is a threaded receptacle which receives the threaded neck of a food containing, squeeze-dash type plastic bottle. The cavity 14 is a rounded channel with a slit or reduced opening at its top identified by numeral 18 while the other cavity 15 is rectangular and is fully open at the top and at one end. The respective cavities 14 and 15 conform to the overall or general shape of the dispensing nozzle portion 16 and the actuator 17 of the combination. Both are dimensioned to respectively, and snugly, receive the rotating and squared arms of the elbow-shaped dispensing unit. The actuator portion 17 is longer than the cavity 15 so that a finger engaging portion 20 protrudes or extends from the exterior surface of the cap 12 whereby a user may readily engage his finger therewith for raising the actuator and rotating the nozzle portion 16 in its rounded cavity 14. Such a position is shown in FIG. 2 which represents the dispensing position for discharging food stuffs from a discharge orifice 21 at an extended portion 22 of the nozzle portion.

Referring now in detail to FIG. 3, it can be seen that the discharge nozzle portion 16 resides in the rounded cavity 14 formed by a sidewall 23 integral with the cap top 13. The sidewall 23 is provided with an aperture 24 which is in fluid communication with the interior of the container 11 via the threaded container neck 25. The dispensing nozzle portion 16 further includes an elongated passageway 26 which terminates at one end in the dispensing discharge hole 21 and at its other end in an orifice 27. As shown in FIG. 3, the orifice 27 is not in registry or indexed with the aperture 24 and the two openings are separated by a sidewall thickness of the dispensing nozzle portion indicated by numeral 28. Therefore, no food product can pass through the aperture 24 into the passageway 26 and the closure means is in its closed or non-dispensing condition.

FIG. 3 also illustrates the reduced entrance leading into the rounded cavity 14 which is formed by a pair of opposing lips 30 and 31 formed by the fact that the cavity wall has an arc greater than 180 degrees. During manufacturing, the rounded dispensing nozzle portion 16 may be readily forced between the opposing lips 30 and 31 so that the reduced entrance expands to accept the thickness of the nozzle portion 16 and so that the nozzle portion can be properly seated within the cavity.

Referring now in detail to FIG. 4, it can be seen that the actuator 17 is in its raised or actuated position so that the dispensing nozzle portion 16 has rotated in cavity 14. The actuator is raised until its backside, indicated by numeral 32 strikes against the shoulder 33 formed at the extreme end of the channel 15. At this time, the hole 27 is in registry with the aperture 24, and passageway 26 is in fluid communication with the interior 11. In actuating the actuator portion 17, it is to be especially noticed that the operator or user's fingers do not come in close proximity with the dispensing orifice 21 or, for that matter, any portion of the dispensing nozzle portion 16.

As shown in FIG. 5, the passageway 26 is in fluid communication with the interior of the container 11, so that food stuffs or products may flow in the direction of arrow 34 for discharge through the discharge orifice 21.

Therefore, it can be seen that the novel rotating, elbow type closure means of the present invention provides a novel structure which is sanitary to use since the user or operator's fingers do not come in contact with the dispensing or discharge orifice 21. The closure means may be readily operated by manipulation of actuator 17. Also, it can be seen that the rectangular actuator portion 17 carries the curvature of the rounded channel across its bottom width so that rotation is unencumbered. The dispensing nozzle portion 16 projects slightly beyond the outer face or surface of the cap for food clearance and cleaning purposes.

The actuating portion 17 projects a bit beyond the rim of the cap to afford good contact of the user's thumb for lifting and extends inward to a right-angled juncture with the rounded dispensing nozzle portion, placing both inner ends, when assembled, at the center of the cap's top. The rounded dispensing nozzle portion 16, serves as an axle and under downward pressure, this axle snaps into the lipped, rounded channel 14 provided in the cap 12.

While particular embodiments of the present invention have been shown and described, it will be obvious to those skilled in the art that changes and modifications may be without departing from this invention in its broader aspects, and therefore, the aim in the appended claims is to cover all such changes and modifications as fall within the true spirit and scope of this invention.

What is claimed is:

1. A sanitary dispensing closure for use in conjunction with a screw-on type, plastic squeeze discharge container comprising the combination of:

a screw-on cap having a cylindrical body closed at one end with a top having a pair of cavities provided therein arranged normal to each other;

a combined actuator and dispensing nozzle arranged normal to each other movably carried in said pair of cavities respectively wherein said actuator moves in and out of its associated cavity and said dispensing nozzle rotates in response to movement of said actuator;

an open-ended passageway extending through said dispensing nozzle terminating at one end in a discharge orifice and at its other end in an inlet port; and said top having an aperture in fluid communication with the interior of the container and adapted to register with said passageway inlet part when said dispensing nozzle is rotated by said actuator.

2. The invention as defined in claim 1 wherein:

a selected one of said pair of cavities is provided with a reduced entrance so as to insertably receive and snap-lock with said dispensing nozzle.

3. The invention as defined in claim 2 wherein:

said dispensing nozzle is cylindrical and said selected one of said pair of cavities is circular.

4. The invention as defined in claim 3 wherein:

said actuator is square in cross section and its associated cavity is square.

5. The invention as defined in claim 4 wherein:

said dispensing nozzle includes a wall thickness adjacent to and covering said top aperture for blocking fluid flow when said actuator is moved into its associated cavity.

6. The invention as defined in claim 5 wherein:

said actuator having terminating end projecting beyond the periphery of said cap when in its associated cavity and finger engaging means provided on said projecting portion.

7. The invention as defined in claim 6 wherein:

said cap is provided with a threaded recess and said top aperture in communication with said recess.

* * * * *